US010962238B2

(12) United States Patent
Nakayama et al.

(10) Patent No.: US 10,962,238 B2
(45) Date of Patent: Mar. 30, 2021

(54) AIR CONDITIONER AND BLOWER DEVICE

(71) Applicant: Toshiba Carrier Corporation, Kawasaki (JP)

(72) Inventors: Satoshi Nakayama, Fuji (JP); Yoshinobu Hamada, Fuji (JP); Nobusato Yoshitake, Fuji (JP); Kiyomi Mochizuki, Fuji (JP)

(73) Assignee: Toshiba Carrier Corporation, Kawasaki (JP)

( * ) Notice: Subject to any disclaimer, the term of this patent is extended or adjusted under 35 U.S.C. 154(b) by 132 days.

(21) Appl. No.: 16/123,424

(22) Filed: Sep. 6, 2018

(65) Prior Publication Data

US 2019/0003728 A1 Jan. 3, 2019

Related U.S. Application Data

(63) Continuation of application No. PCT/JP2016/057018, filed on Mar. 7, 2016.

(51) Int. Cl.
*F24H 3/02* (2006.01)
*F24F 1/0059* (2019.01)
(Continued)

(52) U.S. Cl.
CPC ..... *F24F 1/0059* (2013.01); *F04D 25/166* (2013.01); *F04D 29/054* (2013.01);
(Continued)

(58) Field of Classification Search
CPC ..... F24F 1/0059; F24F 1/0011; F24F 1/0022; F24F 1/0033; F24F 13/20; F24F 13/24;
(Continued)

(56) References Cited

U.S. PATENT DOCUMENTS 2,899,803 A * 8/1959 Paley ..... F24F 13/222 62/291
3,491,550 A * 1/1970 Cavis ..... F24F 13/22 62/285
(Continued)

FOREIGN PATENT DOCUMENTS

JP S58-16399 U 2/1983
JP S61-159063 A 7/1986
(Continued)

OTHER PUBLICATIONS

International Search Report dated May 31, 2016 in connection with PCT International Application No. PCT/JP2016/057018.
(Continued)

*Primary Examiner* — Claire E Rojohn, III
(74) *Attorney, Agent, or Firm* — John P. White

(57) ABSTRACT

According to one embodiment, an air conditioner includes a blower device and a heat exchanger. The blower device includes a fan motor, a fan, a fan case and a coupling member. The fan motor includes a first end section and a second end section separate from each other. The fan is coaxially fixed to a rotating shaft. The fan case accommodating the fan and for guiding air discharged from the fan toward the heat exchanger. The coupling member includes a pair of arm sections respectively coupled to the first end section and the second end section, and a bar-like section extending in the axial direction of the rotating shaft across the arm sections and coupled to the fan case. The fan motor and the fan case are integrally coupled to each other through the coupling member.

3 Claims, 10 Drawing Sheets

(51) Int. Cl.

| | |
|---|---|
| ***F04D 29/054*** | (2006.01) |
| ***F04D 29/66*** | (2006.01) |
| ***F04D 29/42*** | (2006.01) |
| ***F04D 25/16*** | (2006.01) |
| ***F24F 1/0022*** | (2019.01) |
| ***F24F 1/0033*** | (2019.01) |
| ***F24F 1/0011*** | (2019.01) |
| ***F24F 13/20*** | (2006.01) |
| ***F24F 13/24*** | (2006.01) |
| *F24F 13/32* | (2006.01) |

(52) U.S. Cl.
CPC ..... *F04D 29/424* (2013.01); *F04D 29/668* (2013.01); *F24F 1/0011* (2013.01); *F24F 1/0022* (2013.01); *F24F 1/0033* (2013.01); *F24F 13/20* (2013.01); *F24F 13/24* (2013.01); *F24F 13/32* (2013.01); *F24F 2013/205* (2013.01)

(58) Field of Classification Search
CPC ... F24F 13/32; F24F 2013/205; F04D 25/166; F04D 29/054; F04D 29/424; F04D 29/668
USPC ..... 165/120
See application file for complete search history.

(56) References Cited

U.S. PATENT DOCUMENTS 4,597,269 A * 7/1986 Kim, II ..... F24F 13/22 62/286
4,823,558 A * 4/1989 Kim, II ..... F25D 21/14 62/272
4,974,421 A * 12/1990 Kim, II ..... F24F 13/22 62/272
4,986,087 A * 1/1991 Sullivan ..... F24F 1/0007 62/291
5,105,630 A * 4/1992 Kim ..... F24F 13/22 62/285
5,152,154 A * 10/1992 Sullivan ..... F24F 1/0007 62/291
2004/0093885 A1* 5/2004 Ito ..... B60H 1/00028 62/244
2011/0138846 A1* 6/2011 Hayashi ..... F24F 1/0007 62/419

FOREIGN PATENT DOCUMENTS

| | | | |
|---|---|---|---|
| JP | H8-94108 | A | 4/1996 |
| JP | 2005-164073 | A | 6/2005 |
| JP | 2010-127533 | A | 6/2010 |
| JP | 2011-033282 | A | 2/2011 |
| JP | 2012-100394 | A | 6/2012 |
| JP | 2012-191734 | A | 10/2012 |
| JP | 2013-024444 | A | 2/2013 |
| KR | 10-2008-0078280 | A | 8/2008 |
| KR | 10-2013-0043983 | A | 5/2013 |

OTHER PUBLICATIONS

Extended European Search Report dated Sep. 18, 2019 in connection with European Patent Application No. 16893413.1.

* cited by examiner

AIR CONDITIONER AND BLOWER DEVICE

CROSS-REFERENCE TO RELATED APPLICATIONS

This application is a Continuation Application of PCT Application No. PCT/JP2016/057018, filed Mar. 7, 2016, the entire contents of which are incorporated herein by reference.

FIELD

Embodiments described herein relate generally to an air conditioner provided with a blower device configured to supply air to a heat exchanger, and blower device including a multi-blade fan.

BACKGROUND

In an air conditioner including an indoor unit suspended from a beam or the like in the ceiling cavity, the inside of the indoor unit is partitioned into a heat exchanging chamber and a blowing chamber. In the heat exchanging chamber, a heat exchanger configured to carry out heat exchange between a refrigerant and air is arranged. In the blowing chamber, a blower device configured to supply air to the heat exchanger is arranged.

The blower device is provided with a fan motor, multi-blade fan coaxially fixed to a rotating shaft of the fan motor, and a fan case accommodating therein the multi-blade fan. The fan case is an element configured to guide air blown off the multi-blade fan toward the heat exchanger, and is supported by a housing defining the contour of the indoor unit together with the fan motor.

In a blower device including a multi-blade fan, on account of, for example, an imbalance at the center of gravity of the multi-blade fan occurring in the manufacturing process, vibration or the like of the fan motor in operation, there is sometimes a case where the fan case and the housing resonate with each other in a specific rotational speed range to thereby generate noise.

As the countermeasures against the noise, conventionally, although increasing the thickness of the metallic plate constituting the fan case and the housing or reinforcing the fan case has been carried out, a sufficient effect has not been obtained in the present circumstances.

Embodiments described herein aim to obtain an air conditioner and a blower device capable of effectively preventing vibration of the fan case and the housing from occurring and reducing noise.

DETAILED DESCRIPTION

Embodiments of the present invention will be described below with reference to the accompanying drawings.

In general, according to one embodiment, an air conditioner comprises a heat exchanger, a blower device for supplying air to the heat exchanger, and a housing accommodating the heat exchanger and the blower device. The blower device comprises a fan motor, a fan, a fan case and a coupling member. The fan motor comprises a rotating shaft, and a first end section and a second end section separate from each other in an axial direction of the rotating shaft. The fan is coaxially fixed to the rotating shaft rotates following the rotating shaft. The fan case accommodating the fan and for guiding air discharged from the fan toward the heat exchanger. The coupling member comprises a pair of arm sections respectively coupled to the first end section and the second end section of the fan motor, and a bar-like section extending in the axial direction of the rotating shaft across the arm sections and coupled to the fan case. The fan motor and the fan case are integrally coupled to each other through the coupling member.

First Embodiment

Hereinafter, a first embodiment will be described with reference to FIG. 1 through FIG. 9.

Figure 1:
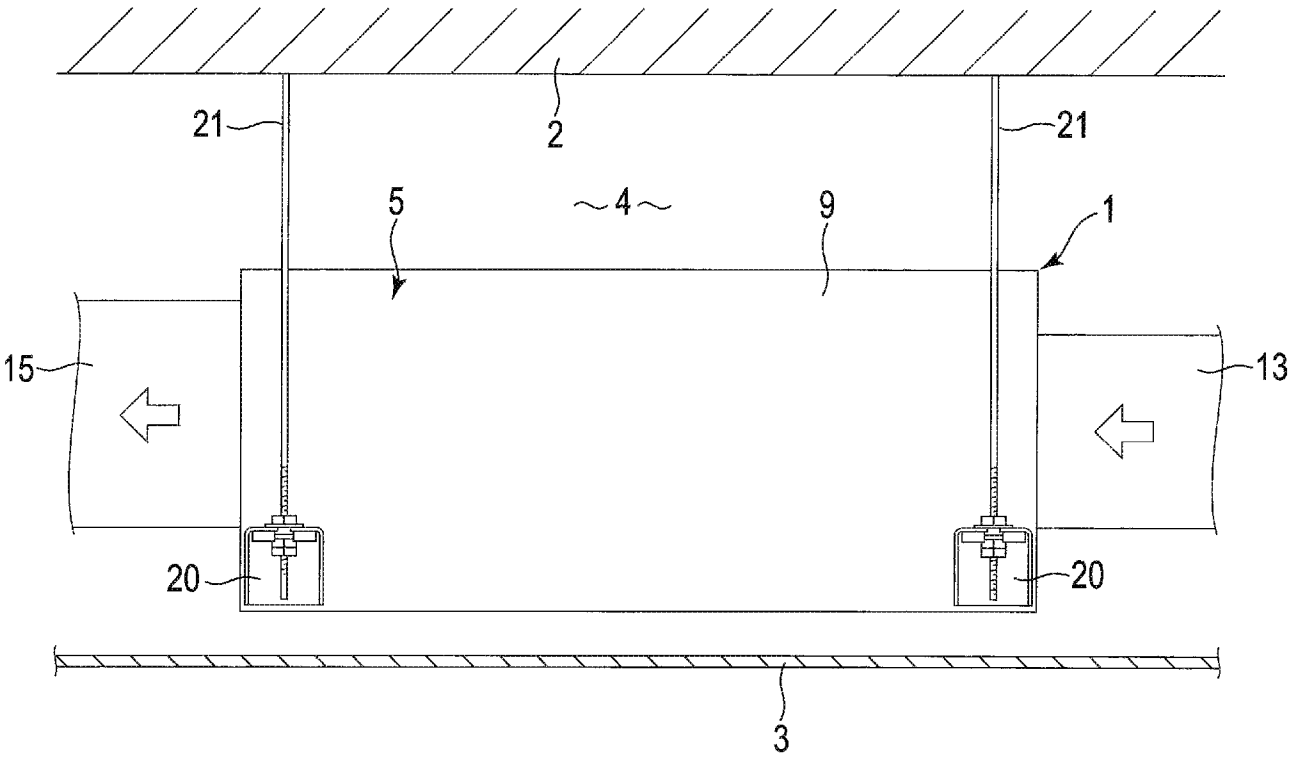
FIG. 1 is a side view schematically showing a state where an indoor unit of an air conditioner is installed in a ceiling cavity in a first embodiment.
Figure 2:
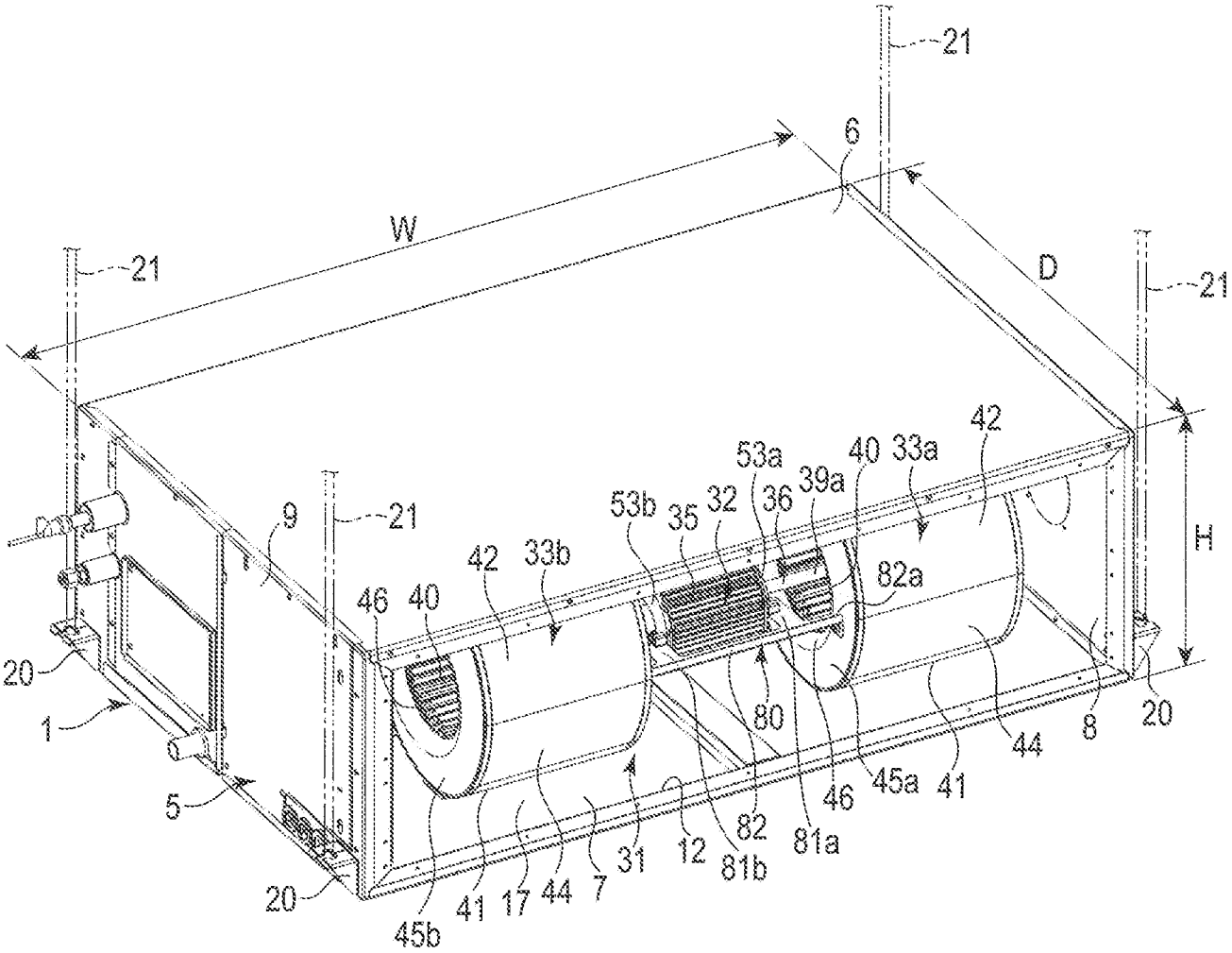
FIG. 2 is a perspective view of the indoor unit according to the first embodiment viewed from the blowing chamber side.
Figure 3:
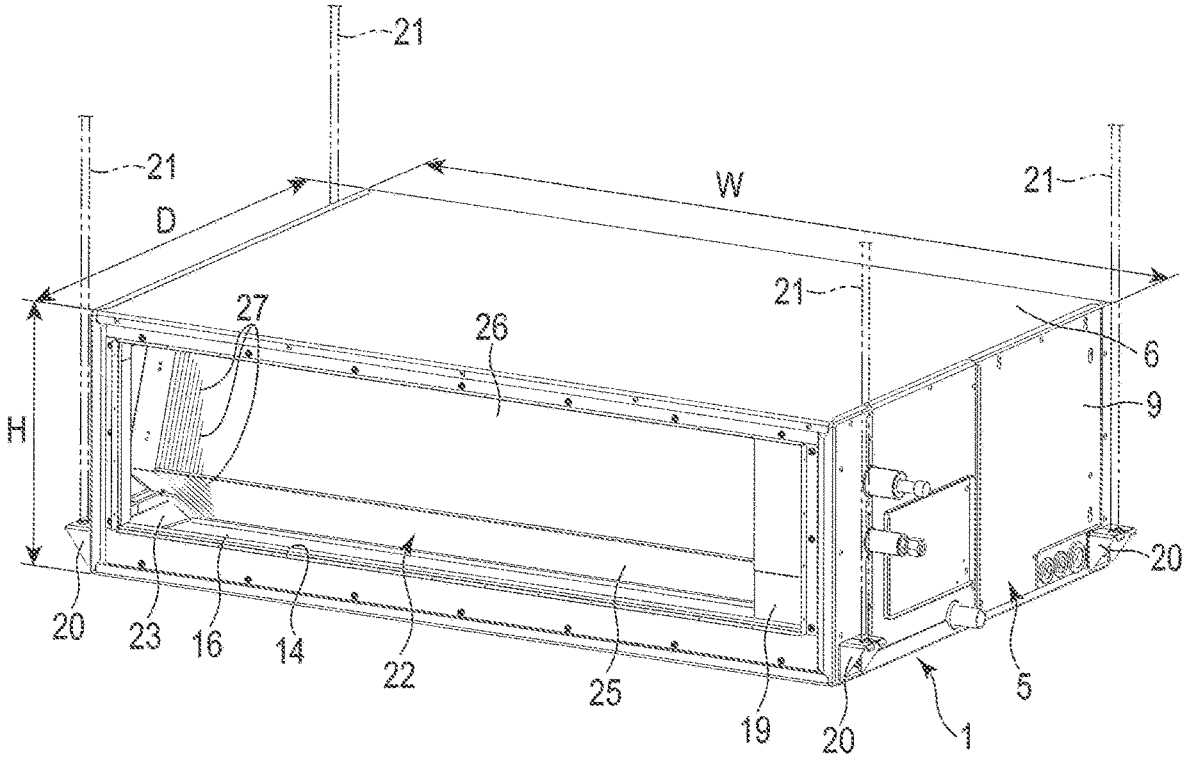
FIG. 3 is a perspective view of the indoor unit according to the first embodiment viewed from the heat exchanging chamber side.
Figure 4:
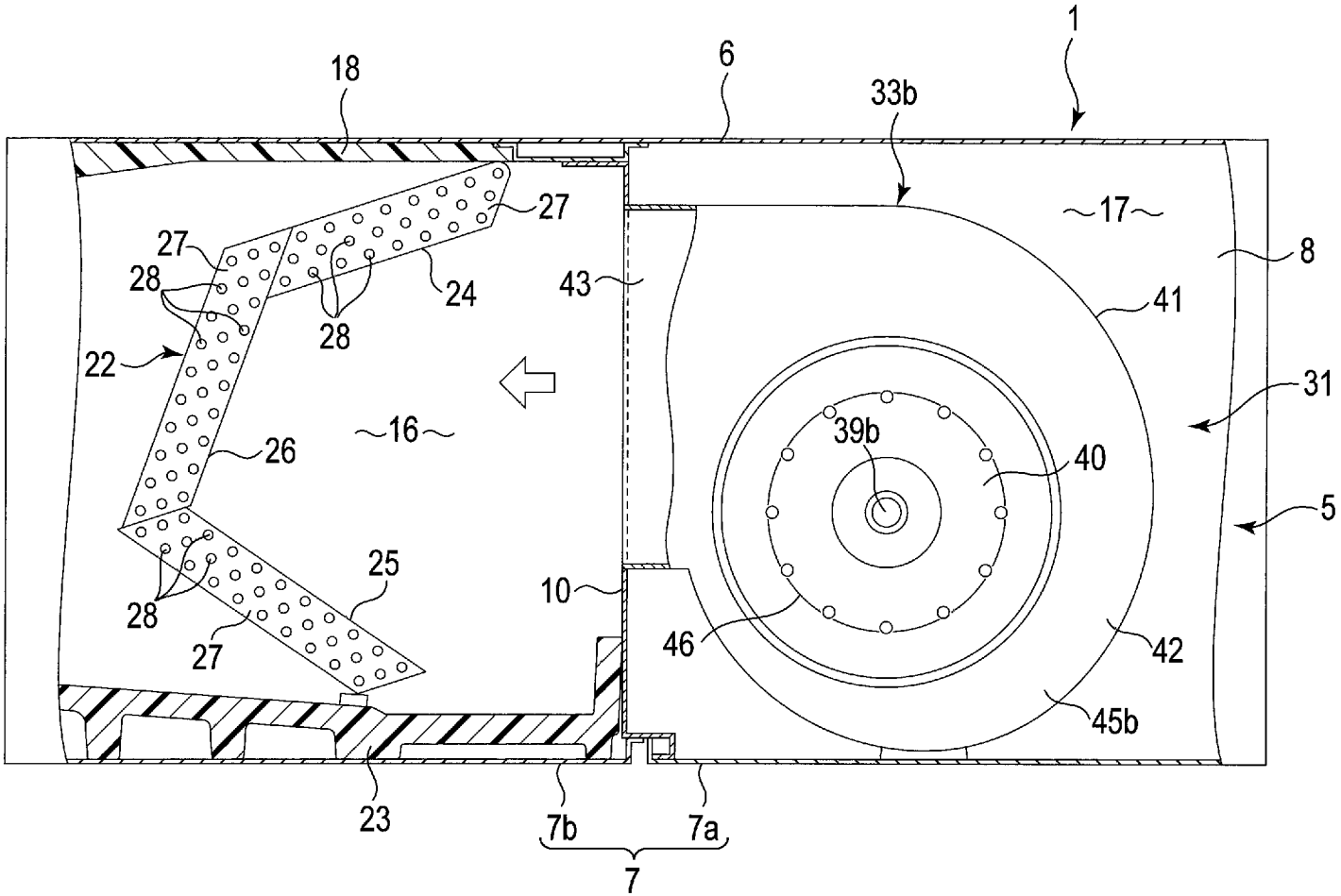
FIG. 4 is a cross-sectional view of the indoor unit according to the first embodiment.

FIG. 1 is a side view schematically showing a state where an indoor unit of an air conditioner is installed in a ceiling cavity, each of FIG. 2 and FIG. 3 is a perspective view of an indoor unit, and FIG. 4 is a cross-sectional view of the indoor unit.

As shown in FIG. 1, an indoor unit 1 is installed in, for example, a ceiling cavity of a house/building. In this embodiment, the ceiling cavity implies a ceiling space 4 defined between a beam 2 of the house/building and a ceiling board 3.

As shown in FIG. 2 and FIG. 3, the indoor unit 1 is a cuboidal flat box-like element, and has a depth dimension D, width dimension W, and thickness dimension H. The depth dimension D of the indoor unit 1 is smaller than the width dimension W. The thickness dimension H of the indoor unit 1 is sufficiently smaller than the depth dimension D and width dimension W.

The indoor unit 1 is provided with a housing 5. The housing 5 is constituted of, for example, thin metallic plates such as sheet-metal members, and defines the contour of the indoor unit 1. The housing 5 includes, as major elements, a top plate 6, a bottom plate 7, a first side plate 8, a second side plate 9, and a partition plate 10.

The top plate 6 and the bottom plate 7 extend in the horizontal direction, and are opposed to each other with an interval held between them in the thickness direction of the housing 5. According to this embodiment, the bottom plate 7 is divided into two parts of a first plate section 7*a* and a second plate section 7*b*. Regarding each of the first plate section 7*a* and the second plate section 7*b*, a length in the depth direction of the housing 5 is set to about half the depth dimension D of the indoor unit 1.

The first side plate 8 and the second side plate 9 vertically stand to extend across the top plate 6 and the bottom plate 7, and are opposed to each other with an interval held between them in the width direction of the housing 5.

As shown in FIG. 2, the top plate 6, the bottom plate 7, the first side plate 8, and the second side plate 9 define a suction opening 12 at the one end of the housing 5 in the depth direction of the housing 5. The suction opening 12 has a long and thin opening shape in the width direction of the housing 5. The suction opening 12 is connected to a suction duct 13 shown in FIG. 1 through a filter not shown.

As shown in FIG. 3, the top plate 6, the bottom plate 7, the first side plate 8 and the second side plate 9 define a blow-off opening 14 at the other end of the housing 5 in the depth direction of the housing 5. The blow-off opening 14 has a long and thin opening shape in the width direction of the housing 5. The blow-off opening 14 is connected to a blow-off duct 15 shown in FIG. 1 on the opposite side of the suction opening 12.

As shown in FIG. 4, the partition plate 10 partitions the inside of the housing 5 into two chambers of a heat exchanging chamber 16 and a blowing chamber 17. The heat exchanging chamber 16 communicates with the blow-off opening 14 of the housing 5. The blowing chamber 17 communicates with the suction opening 12 of the housing 5.

An inner surface of the top plate 6 facing the heat exchanging chamber 16 is covered with, for example, a heat insulating material 18 such as foamed polystyrene. Likewise, an inner surface of the second side plate 9 facing the heat exchanging chamber 16 is covered with another heat insulating material not shown.

A machine chamber 19 is formed at an end part of the heat exchanging chamber 16 adjacent to the second side plate 9. The machine chamber 19 is an independent chamber separate from the heat exchanging chamber 16, and refrigeration cycle devices (not shown) such as a drain pump, a refrigerant distributor, and a plurality of refrigerant piping elements are accommodated in the machine chamber 19.

Furthermore, hanging metal fittings 20 are fixed to four corner parts of the housing 5. The hanging metal fittings 20 horizontally protrude from the four corner parts of the housing 5 in four directions of the housing 5, and lower end parts of four hanging bolts 21 downwardly extending from the beam 2 of the house/building are coupled to the hanging metal fittings 20.

Accordingly, the housing 5 is suspended from the beam 2 of the house/building through the hanging bolts 21.

As shown in FIG. 3 and FIG. 4, a heat exchanger 22 and a drain pan 23 are accommodated in the heat exchanging chamber 16 of the housing 5. The heat exchanger 22 extends in the width direction of the housing 5. The drain pan 23 is constituted of, for example, a heat insulating material such as foamed polystyrene. The drain pan 23 supports the heat exchanger 22 from below in such a manner as to receive drain water dripping from the heat exchanger 22, and surrounds the heat exchanger 22 in cooperation with the heat insulating material 18. Furthermore, an undersurface of the drain pan 23 is covered with the second plate section 7*b* of the bottom plate 7.

As shown in FIG. 4 in the best manner, the heat exchanger 22 of this embodiment is provided with a first heat exchanging unit 24, a second heat exchanging unit 25, and a third heat exchanging unit 26. The first to third heat exchanging units 24, 25, and 26 are elements independent of each other, and are combined into a predetermined three-dimensional solid shape.

Each of the first to third heat exchanging units 24, 25, and 26 is provided with a plurality of long and thin plate-like fins 27, and a plurality of heat-transfer tubes 28 through which the refrigerant flows. The fins 27 are arranged with intervals held between them in the width direction of the housing 5. The heat-transfer tubes 28 continuously penetrate adjacent the fins 27 to thereby be integrated with the fins 27.

The first heat exchanging unit 24 is positioned at an upper part of the heat exchanging chamber 16. The first heat exchanging unit 24 extends from the partition plate 10 toward the blow-off opening 14 of the housing 5 in the depth direction of the housing 5, and is somewhat downwardly inclined toward the blow-off opening 14.

The second heat exchanging unit 25 is positioned at a bottom part of the heat exchanging chamber 16, and is separate from the first heat exchanging unit 24 in the thickness direction of the housing 5. The second heat exchanging unit 25 extends from the partition plate 10 toward the blow-off opening 14 of the housing 5 in the depth direction of the housing 5, and is somewhat upwardly inclined toward the blow-off opening 14. Accordingly, each of the first heat exchanging unit 24 and the second heat exchanging unit 25 has one end positioned closer to the blow-off opening 14 side than to the partition plate 10 side.

The third heat exchanging unit 26 is interposed between the one end of the first heat exchanging unit 24 and the one end of the second heat exchanging unit 25. The third heat exchanging unit 26 is made to stand in opposition to the partition plate 10, and is upwardly inclined to extend from the one end of the second heat exchanging unit 25 to the one end of the first heat exchanging unit 24 to thereby be made closer to the partition plate 10.

Accordingly, in this embodiment, the first to third heat exchanging units 24, 25, and 26 are combined with each other into a shape spreading toward the partition plate 10 when viewed from the side.

As shown in FIG. 2, and FIG. 4 through FIG. 6, a blower device 31 is accommodated in the blowing chamber 17. The blower device 31 includes, as major elements, a fan motor 32, a first fan unit 33*a*, and a second fan unit 33*b*.

The fan motor 32 is provided with a cylindrical motor housing 35 accommodating therein a stator and a rotor, and a rotating shaft 36 coaxially supported by the motor housing 35. The motor housing 35 includes a first boss section 37*a* and a second boss section 37*b*.

The first boss section 37*a* is an example of a first end section, and is protruded from the one end face of the motor housing 35 in the axial direction thereof. The second boss section 37*b* is an example of a second end section, and is protruded from the other end face of the motor housing 35 in the axial direction thereof. According to this embodiment, an annular rubber vibration insulator 38 is coaxially fitted on the outer circumferential surface of each of the first boss section 37*a* and the second boss section 37*b*.

The rotating shaft 36 includes a first shaft section 39*a* and a second shaft section 39*b*. The first shaft section 39*a* and the second shaft section 39*b* are arranged coaxial with each other. The first shaft section 39*a* penetrates the first boss section 37*a* to outwardly protrude from the motor housing 35. The second shaft section 39*b* penetrates the second boss section 37*b* to outwardly protrude from the motor housing 35. Accordingly, the first boss section 37*a* and the second boss section 37*b* of the motor housing 35 are separate from each other in the axial direction of the rotating shaft 36.

The first fan unit 33*a* and the second fan unit 33*b* are arranged in opposition to each other with an interval held between them, and with the fan motor 32 interposed between them. Each of the first fan unit 33*a* and the second fan unit 33*b* has a configuration common to them. Accordingly, in this embodiment, the first fan unit 33*a* will be described as a representative, and constituent elements of the second fan unit 33*b* are denoted by reference symbols identical to the first fan unit 33*a*, and their descriptions are omitted.

Figure 5:
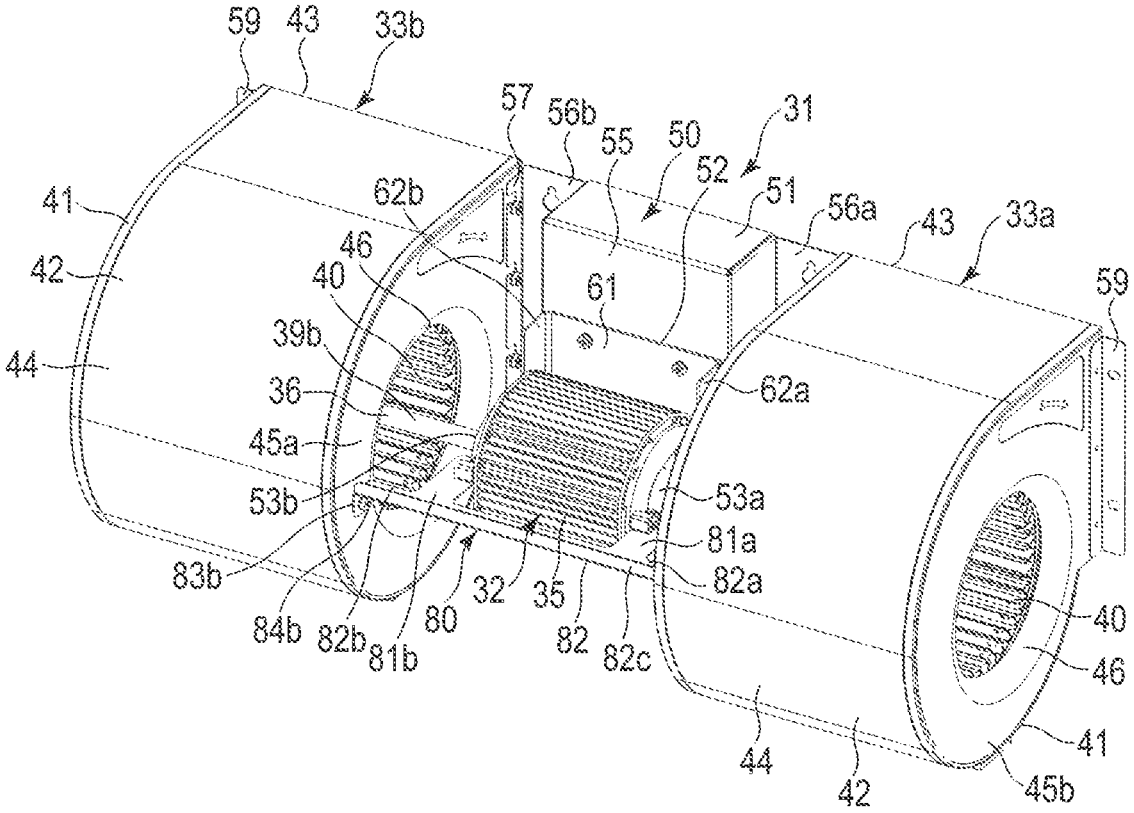
FIG. 5 is a perspective view of a blower device to be applied to the indoor unit of the first embodiment.
Figure 6:
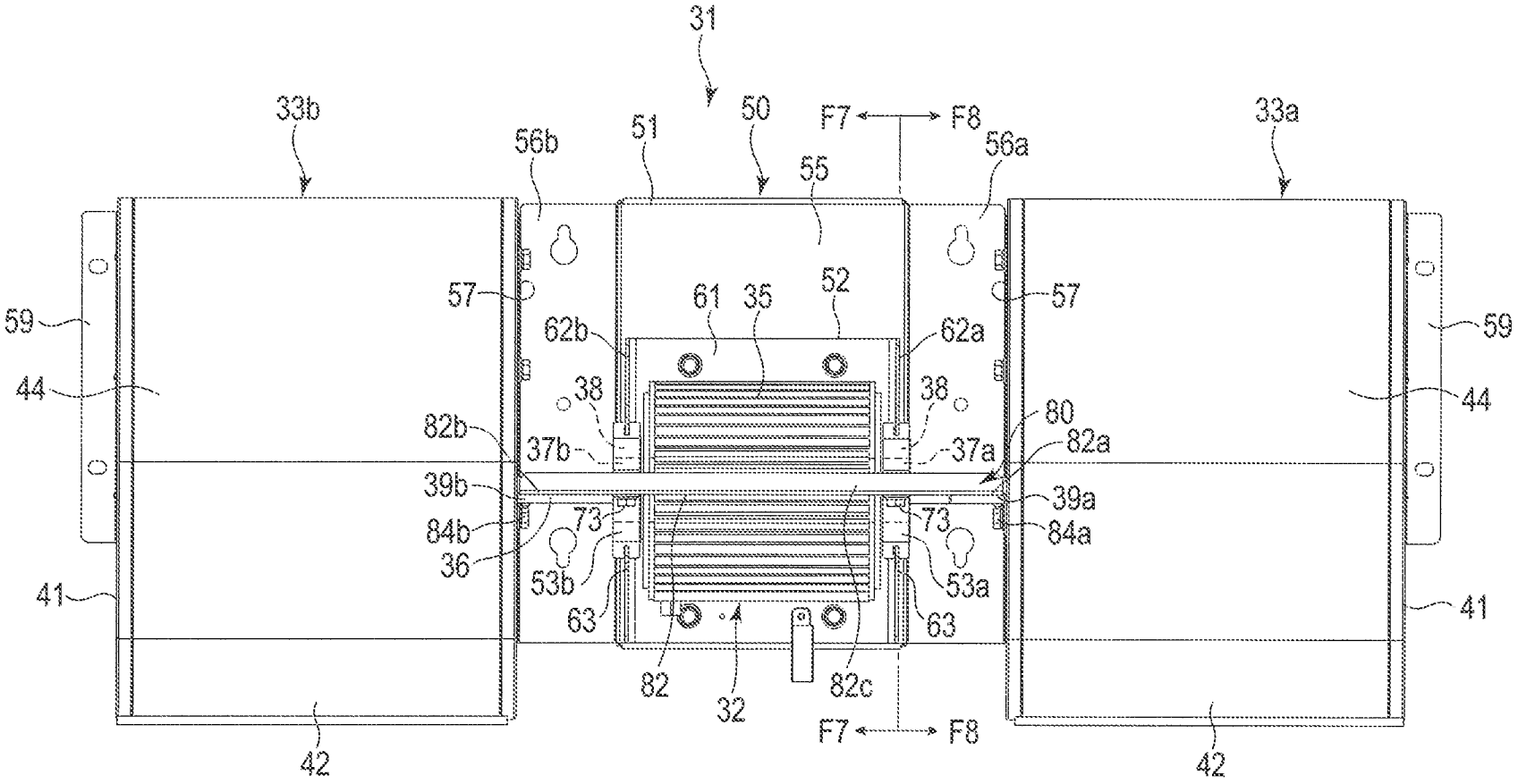
FIG. 6 is a front view of the blower device to be applied to the indoor unit of the first embodiment.

As shown in FIG. 2 and FIG. 5, the first fan unit 33*a* is provided with a cylindrical multi-blade fan 40 and a fan case 41. The multi-blade fan 40 is coaxially attached to a leading end part of the first shaft section 39*a* so that the fan 40 can rotate following the rotating shaft 36. When rotating, the multi-blade fan 40 sucks air from the axial direction, and pressurizes the sucked air to discharge the pressurized air from the outer circumferential part thereof in the circumferential direction.

The fan case 41 is constituted of, for example, thin metallic plates such as sheet-metal members. The fan case 41 is provided with a case main body 42 accommodating therein the multi-blade fan 40, and nozzle section 43 provided on the case main body 42.

The case main body 42 includes an outer circumferential wall 44 curved along the outer circumferential part of the multi-blade fan 40, and a pair of end walls 45*a* and 45*b* positioned on both sides of the multi-blade fan 40 in the axial direction thereof. Each of the end walls 45*a* and 45*b* includes a circular air suction hole 46. The first shaft section 39*a* of the rotating shaft 36 penetrates the air suction hole 46 of the one end wall 45*a*.

As shown in FIG. 4, the nozzle section 43 of the fan case 41 protrudes from the case main body 42 toward the partition plate 10 of the housing 5. The front end of the nozzle section 43 penetrates the partition plate 10, is opened to the heat exchanging chamber 16, and is opposed to the heat exchanger 22.

In the second fan unit 33*b*, the multi-blade fan 40 is coaxially attached to the leading end part of the second shaft section 39*b* of the rotating shaft 36. The other items concerning the fan case 41 are identical to the first fan unit 33*a*.

Accordingly, when the multi-blade fan 40 rotates, air is sucked into the inside of the multi-blade fan 40 through the air suction hole 46. The configuration is contrived in such a manner that the air sucked into the multi-blade fan 40 is discharged from the outer circumferential part of the multi-blade fan 40 in the circumferential direction, and is blown from the nozzle section 43 toward the heat exchanger 22.

As shown in FIG. 5 through FIG. 9, the fan motor 32 is installed in the blowing chamber 17 through a motor fixing device 50. The motor fixing device 50 includes, as major elements, a motor supporting table 51, a motor base 52, and a pair of motor bands 53*a* and 53*b*.

The motor supporting table 51 is constituted of, for example, thin metallic plates such as sheet-metal members, and is positioned between the first fan unit 33*a* and the second fan unit 33*b*. The motor supporting table 51 includes a flat supporting surface 55, and a pair of flange sections 56*a* and 56*b*.

The supporting surface 55 is made to vertically stand inside the blowing chamber 17. The one flange section 56*a* protrudes from the one side edge of the motor supporting table 51 toward the first fan unit 33*a*. The other flange section 56*b* protrudes from the other side edge of the motor supporting table 51 toward the second fan unit 33*b*.

The pair of flange sections 56*a* and 56*b* are fixed to the partition plate 10 exposed to the blowing chamber 17 through a plurality of fastening members such as bolts and nuts. Accordingly, the motor supporting table 51 is supported by the partition plate 10.

At a front end edge section of each of the flange sections 56*a* and 56*b*, an attaching piece 57 folded back at right angles in a direction away from the partition plate 10 is formed. The attaching piece 57 is coupled to the end wall 45*a* of the fan case 41 through a plurality of fastening members such as bolts and nuts.

Furthermore, a bracket 59 is attached to the end wall 45*b* of the fan case 41. The bracket 59 is directly fixed to the partition plate 10 exposed to the blowing chamber 17 through a plurality of fastening members such as bolts and nuts.

As a result, each of the fan case 41 of the first fan unit 33*a*, and the fan case 41 of the second fan unit 33*b* is supported by the partition plate 10.

The motor base 52 of the motor fixing device 50 is constituted of, for example, thin metallic plates such as sheet-metal members. The motor base 52 is provided with a base plate section 61 and a pair of supporting sections 62*a* and 62*b*.

The base plate section 61 is a flat rectangular plate-like element, and is fixed to the supporting surface 55 of the motor supporting table 51 at four corners thereof through a plurality of fastening members such as bolts and nuts.

The one supporting section 62*a* is folded back at right angles from the one side edge of the base plate section 61 in a direction away from the supporting surface 55. Likewise, the other supporting section 62*b* is folded back at right angles from the other side edge of the base plate section 61 in a direction away from the supporting surface 55. Accordingly, the pair of supporting sections 62*a* and 62*b* are arranged in parallel with each other with an interval held between them in the width direction of the housing 5, and vertically stand inside the blowing chamber 17.

At a central part of each of the pair of supporting sections 62*a* and 62*b* in the height direction, a motor receiving section 63 is formed. The motor receiving section 63 protrudes in a direction away from the motor supporting table 51. The motor receiving section 63 is provided with a concave section 64 curved into an arc-like shape, a first hook section 65 protruding from a tip end of the motor receiving section 63 toward a position above the concave section 64, and a second hook section 66 protruding from the tip end of the motor receiving section 63 toward a position beneath the concave section 64.

The concave section 64 of the motor receiving section 63 is an element configured to receive the rubber vibration insulator 38 of the fan motor 32. In this embodiment, the rubber vibration insulator 38 corresponding to the first boss section 37*a* of the fan motor 32 is fitted into the concave section 64 of the one supporting section 62*a*, and rubber vibration insulator 38 corresponding to the second boss section 37*b* is fitted into the concave section 64 of the other supporting section 62*b*.

Each of the motor bands 53*a* and 53*b* is an example of a fixing member, and has a configuration common to them. Accordingly, in this embodiment, the one motor band 53*a* will be described as a representative. The motor band 53*a* is constituted of, for example, thin metallic plates such as sheet-metal members, and is divided into two elements of a first band section 68*a* and a second band section 68*b*.

Figure 7:
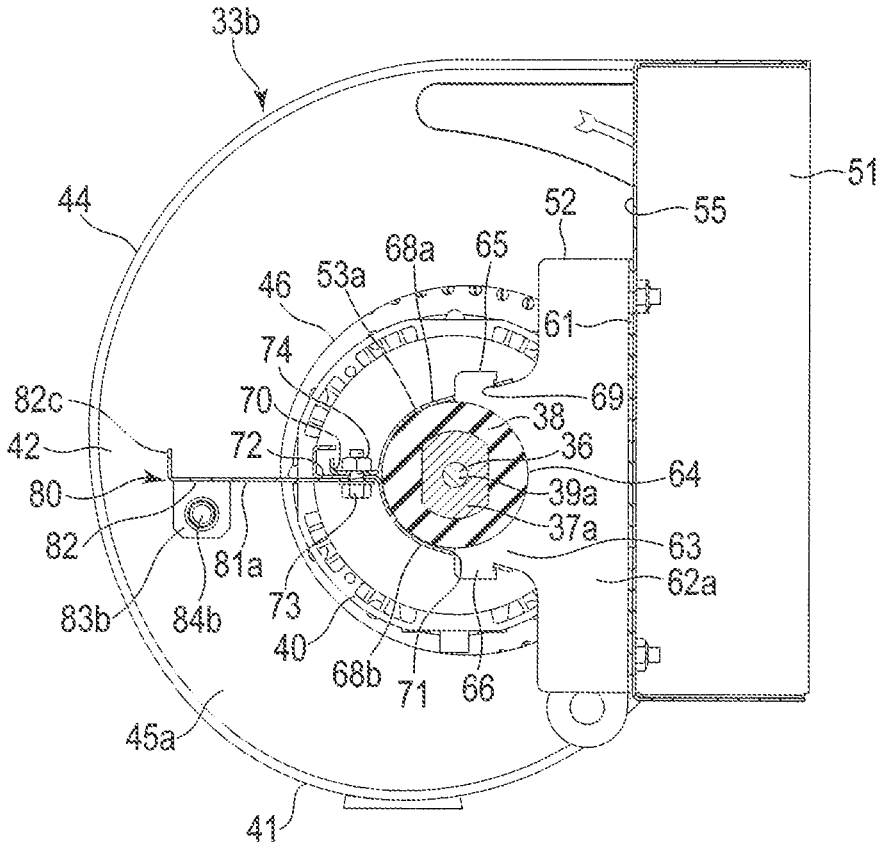
FIG. 7 is a cross-sectional view along line F7-F7 of FIG. 6.
Figure 8:
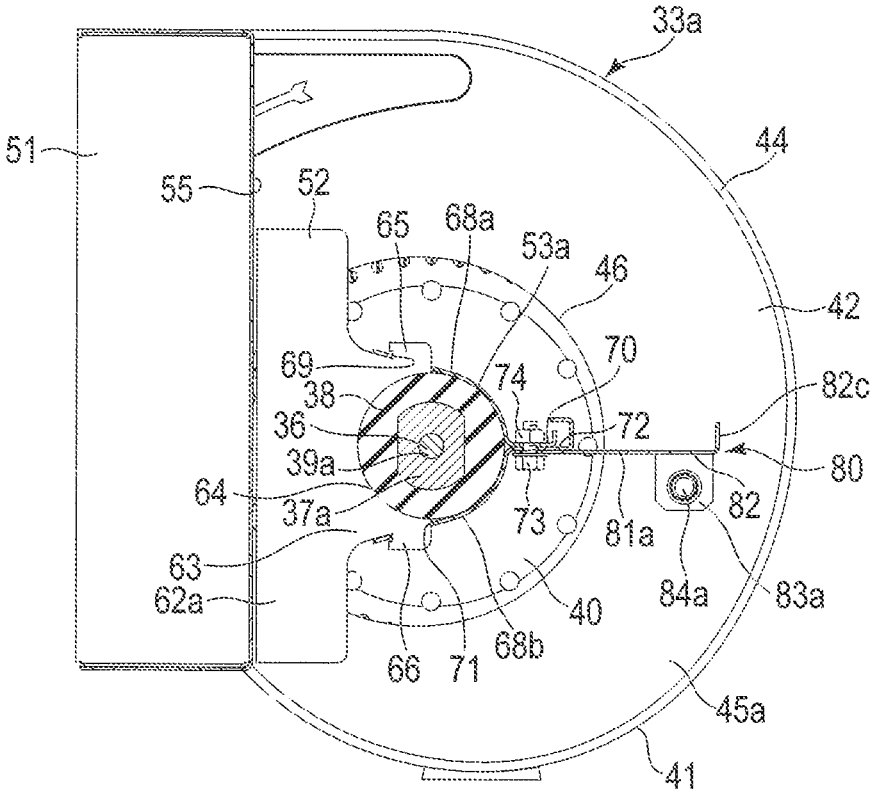
FIG. 8 is a cross-sectional view along line F8-F8 of FIG. 6.
Figure 9:
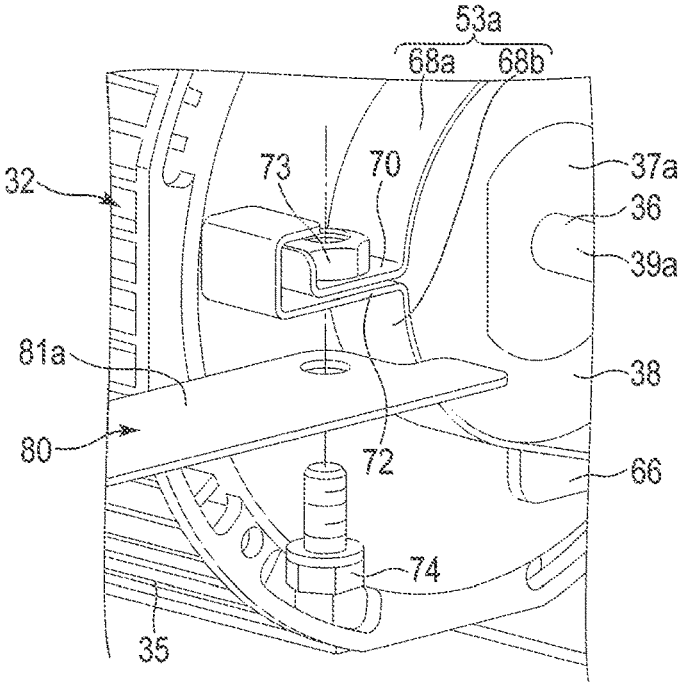
FIG. 9 is a perspective view showing a positional relationship between a coupling member and fixing metal fittings.

As shown in FIG. 7 through FIG. 9, each of the first band section 68*a* and the second band section 68*b* is curved into an arc-like shape along the outer circumferential surface of the rubber vibration insulator 38. At the one end of the first band section 68*a*, a slit 69 in which the first hook section 65 of the motor receiving section 63 is detachably caught is formed. At the other end of the first band section 68*a*, a coupling section 70 horizontally protruding in a direction away from the rubber vibration insulator 38 is formed.

Likewise, at the one end of the second band section 68*b*, a slit 71 in which the second hook section 66 of the motor receiving section 63 is detachably caught is formed. At the other end of the second band section 68*b*, a coupling section 72 horizontally protruding in a direction away from the rubber vibration insulator 38 is formed.

The coupling section 70 of the first band section 68*a* and the coupling section 72 of the second band section 68*b* are combined with each other through a bolt 73 and nut 74 to be used as fastening members in a state where the coupling section 70 and coupling section 72 are laid one on top of another. The motor bands 53*a* and 53*b* hold down the rubber vibration insulators 38 in cooperation with the concave sections 64 of the supporting sections 62*a* and 62*b*, thereby retaining the rubber vibration insulators 38.

Accordingly, the fan motor 32 is rubber-mounted on the motor base 52 through the rubber vibration insulators 38, and the rubber vibration insulators 38 are configured to absorb the vibration of the fan motor 32.

As shown in FIG. 5 through FIG. 8, the fan motor 32, the first fan unit 33*a*, and the second fan unit 33*b* are integrally combined with each other through a coupling member 80. The coupling member 80 is constituted of, for example, thin metallic plates such as sheet-metal members.

The coupling member 80 is an integrally structured object including a pair of arm sections 81*a* and 81*b* and straight bar-like section 82. A base end of the one arm section 81*a* is coupled to the first boss section 37*a* of the fan motor 32 through the motor band 53*a*. A base end of the other arm section 81*b* is coupled to the second boss section 37*b* of the fan motor 32 through the motor band 53*b*.

The coupling structure of each of the arm sections 81*a* and 81*b* is common to them, and hence the one arm section 81*a* will be described as a representative. That is, as shown in FIG. 7 through FIG. 9, the base end of the arm section 81*a* is jointly coupled to the undersurface of the coupling section 72 of the second band section 68*b* constituting the motor band 53*a* through a bolt 73.

Accordingly, the arm sections 81*a* and 81*b* horizontally extend in directions away from the supporting sections 62*a* and 62*b* of the motor base 52 with an interval held between them, and the fan motor 32 is interposed between the arm sections 81*a* and 81*b*.

The bar-like section 82 horizontally extends in the axial direction of the rotating shaft 36 of the fan motor 32 across the tip ends of the arm sections 81*a* and 81*b*. The bar-like section 82 includes a first extension section 82*a* extended from the one arm section 81*a* toward the fan case 41 of the first fan unit 33*a*, and a second extension section 82*b* extended from the other arm section 81*b* toward the fan case 41 of the second fan unit 33*b*.

Furthermore, a reinforcing flange section 82*c* upwardly folded back at right angles is formed at the one side edge of the bar-like section 82 in the longitudinal direction of the bar-like section 82 including the first extension section 82*a* and the second extension section 82*b*. By virtue of the existence of the flange section 82*c*, the rigidity of the bar-like section 82 is secured.

At a tip end of the first extension section 82*a*, a fixing piece 83*a* downwardly folded back at right angles is formed. Likewise, at a tip end of the second extension section 82*b*, a fixing piece 83*b* downwardly folded back at right angles is formed.

The one fixing piece 83*a* of the bar-like section 82 is coupled to the end wall 45*a* of the fan case 41 of the first fan unit 33*a* by means of a bolt 84*a*. The other fixing piece 83*b* of the bar-like section 82 is coupled to the end wall 45*a* of the fan case 41 of the second fan unit 33*b* by means of a bolt 84*b*.

Accordingly, the bar-like section 82 of the coupling member 80 integrally couples the fan case 41 of the first fan unit 33*a* and the fan case 41 of the second fan unit 33*b* to each other on the opposite side of the motor supporting table 51. In other words, the fan motor 32 is positioned between the bar-like section 82 and the motor base 52, and the fan motor 32 is surrounded by the motor base 52, the arm sections 81*a* and 81*b* of the coupling member 80, and the bar-like section 82 of the coupling member 80.

Furthermore, the arm sections 81*a* and 81*b* and bar-like section 82 cooperate with each other to integrally couple the fan motor 32 and the fan case 41 of the first fan unit 33*a*, and the fan motor 32 and the fan case 41 of the second fan unit 33*b* together.

According to the first embodiment, the fan motor 32, the fan case 41 of the first fan unit 33*a*, and the fan case 41 of the second fan unit 33*b* are integrally coupled together through the coupling member 80 on the opposite side of the motor supporting table 51.

Accordingly, it is possible to enhance the rigidity of the fan case 41 constituted of thin metallic plates by utilizing the coupling member 80. Thus, even when vibration incidental to, for example, an imbalance at the center of gravity of the multi-blade fan 40 occurring in the manufacturing process or vibration incidental to the operation of the fan motor 32 is transmitted to the fan case 41, the fan case 41 hardly becomes vibrant.

Moreover, the coupling member 80 includes the bar-like section 82 extending between the fan case 41 of the first fan unit 33*a* and the fan case 41 of the second fan unit 33*b* in the axial direction of the rotating shaft 36 of the fan motor 32. Thereby, when the fan motor 32 is in operation, even if, for example, rolling in the axial direction of the rotating shaft 36 occurs in the fan motor 32, it is possible to restrain the rolling of the fan motor 32 by means of the bar-like section 82.

Furthermore, in a resonant state occurring when the natural frequency of the fan case 41 coincides with the rotational speed of the multi-blade fan 40, and in a mode in which the fan motor 32 and the fan case 41 vibrate out of phase with each other, it becomes possible to cancel out the vibration of the fan case 41 by coupling the fan motor 32 and the fan case 41 to each other by using the coupling member 80.

As a result, even in a natural vibration mode in which rolling occurs in the fan motor 32, it is possible to prevent resonance of the fan case 41 from occurring, and a quiet operation in which noise resulting from vibration is prevented from occurring is enabled.

Moreover, according to the first embodiment, the arm sections 81*a* and 81*b* of the coupling member 80 are jointly coupled to the motor bands 53*a* and 53*b*, respectively by means of the bolts 73 and nuts 74. Accordingly, it is possible to omit dedicated bolts configured to couple the arm sections 81*a* and 81*b* of the coupling member 80 to the first boss section 37*a* and the second boss section 37*b* of the fan motor 32.

Accordingly, an advantage that it is possible to reduce the number of components of the blower device 31 to thereby contribute to cost reduction and weight reduction of the indoor unit 1 is obtained.

Second Embodiment

Figure 10:
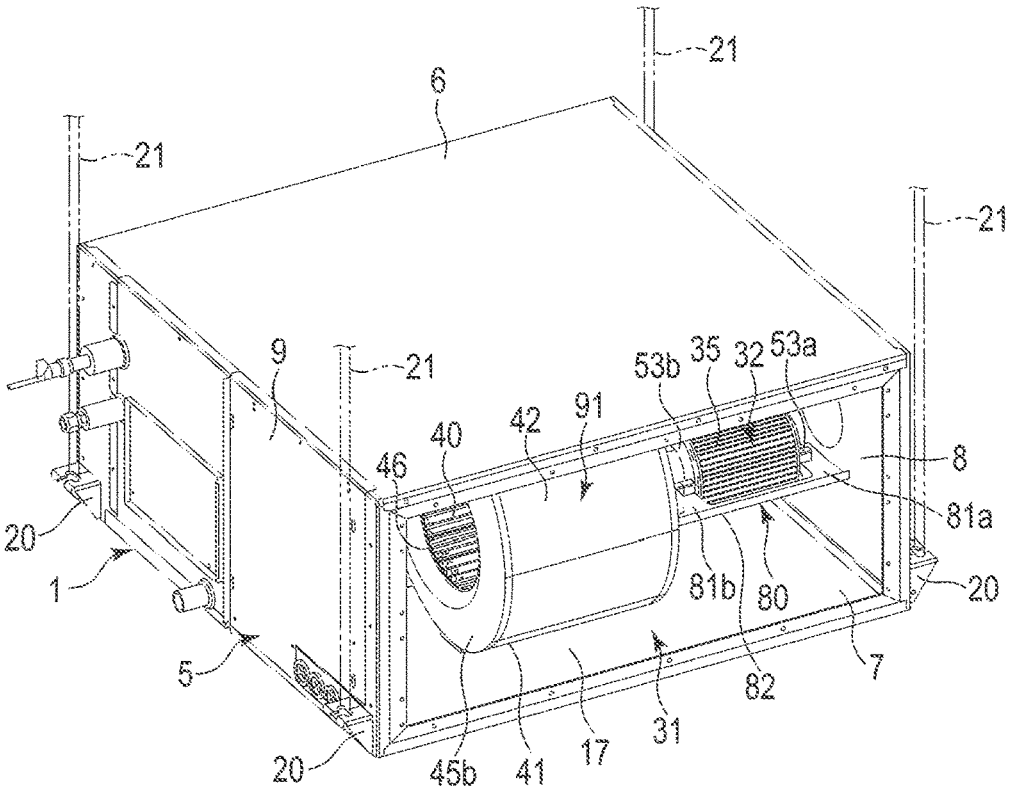
FIG. 10 is a perspective view of an indoor unit according to a second embodiment.
Figure 11:
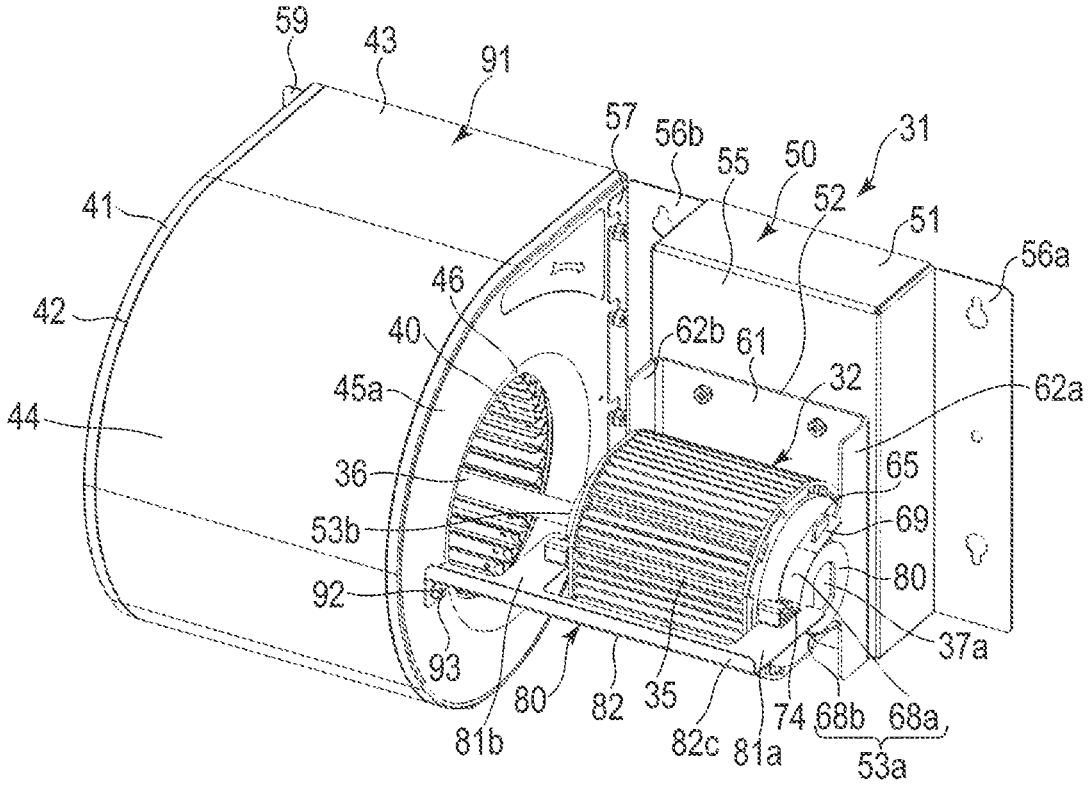
FIG. 11 is a perspective view of a blower device to be applied to the indoor unit of the second embodiment.

FIG. 10 and FIG. 11 disclose a second embodiment. The second embodiment differs from the first embodiment in the configuration of the blower device 31. More specifically, a blower device 31 is provided with one fan unit 91. The configuration of the fan unit 91 is identical to the first fan unit 33*a* of the first embodiment, and hence constituent elements of the fan unit 91 are denoted by reference symbols identical to the first fan unit 33*a*, and their descriptions are omitted.

According to the second embodiment, a rotating shaft 36 of a fan motor 32 penetrates a first end section of a motor housing 35 to protrude to the outside of the motor housing 35. A multi-blade fan 40 is coaxially fixed to a protrusion end of the rotating shaft 36. Accordingly, the fan unit 91 is positioned on one side of the fan motor 32 in an axial direction of the fan motor 32.

In a coupling member 80 configured to couple the fan motor 32 and the fan case 41 of the fan unit 91 to each other, only one end part of a bar-like section 82 extending across the arm sections 81*a* and 81*b* is extended toward the fan unit 91, and a fixing piece 92 is formed at one end part of the bar-like section 82. The fixing piece 92 is coupled to an end wall 45*a* of the fan case 41 through a bolt 93.

In the second embodiment described above too, it is possible to enhance the rigidity of the fan case 41 constituted of thin metallic plates by utilizing the coupling member 80. Furthermore, even when rolling in the axial direction of the rotating shaft 36 occurs in the fan motor 32, it is possible to restrain the rolling of the fan motor 32 by means of the bar-like section 82.

Accordingly, it is possible to prevent resonance of the fan case 41 from occurring, and restrain occurrence of noise resulting from vibration as in the case of the first embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air conditioner comprising:

a heat exchanger configured to carry out heat exchange between a refrigerant and air;

a blower device configured to supply air to the heat exchanger, the blower device including:

a fan motor including a rotating shaft and a first end section and a second end section separate from each other in an axial direction of the rotating shaft;

a fan coaxially fixed to the rotating shaft of the fan motor and configured to rotate following the rotating shaft;

a fan case accommodating therein the fan and configured to guide air blowing off the fan toward the heat exchanger; and a coupling member including a pair of arm sections coupled to the first end section and the second end section, respectively, of the fan motor, and a bar-like section extending in the axial direction of the rotating shaft across the arm sections and coupled to the fan case, the fan motor and the fan case being integrally coupled to each other through the coupling member;

a housing accommodating therein the heat exchanger and the blower device, the housing including:

a heat exchanging chamber accommodating therein the heat exchanger;

a blowing chamber accommodating therein the blower device;

a partition plate separating the heat exchanging chamber and the blowing chamber from each other; and a motor fixing device configured to install the fan motor in the blowing chamber, the motor fixing device including:

a motor supporting table arranged in the blowing chamber;

a motor base attached to the motor supporting table and including a pair of supporting sections configured to receive the first end section and the second end section, respectively, of the fan motor; and a pair of fixing members configured to hold down the first end section and the second end section, respectively, of the motor in cooperation with the supporting sections of the motor base to thereby retain the respective end sections, wherein the fixing members of the motor fixing device are coupled to the respective arm sections of the coupling member of the blower device.

2. The air conditioner of claim 1, wherein each of the fixing members is divided into a pair of band sections, an end of each of the band sections is engaged with each of the supporting sections of the motor base, and the other ends of the band sections are coupled to each other by means of fastening members.

3. The air conditioner of claim 2, wherein each of the arm sections of the coupling member is jointly coupled to each of the fixing members through the fastening members.

* * * * *